US009488062B2

(12) United States Patent
Black et al.

(10) Patent No.: US 9,488,062 B2
(45) Date of Patent: Nov. 8, 2016

(54) INNER TURBINE SHELL AXIAL MOVEMENT

(75) Inventors: Kenneth Black, Greenville, SC (US); Rohit Pruthi, Bangalore (IN); Sanjay Shankar Jadhav, Bangalore (IN); Pradeep Ghute, Bangalore (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1157 days.

(21) Appl. No.: 13/468,437

(22) Filed: May 10, 2012

(65) Prior Publication Data

US 2013/0302147 A1 Nov. 14, 2013

(51) Int. Cl.
*F01D 11/22* (2006.01)
*F01D 17/14* (2006.01)

(52) U.S. Cl.
CPC ..... *F01D 11/22* (2013.01); *F01D 17/143* (2013.01); *F05D 2250/292* (2013.01); *F05D 2250/41* (2013.01); *F05D 2260/57* (2013.01); *F05D 2270/20* (2013.01); *F05D 2270/44* (2013.01); *F05D 2270/64* (2013.01); *F05D 2270/65* (2013.01)

(58) Field of Classification Search
CPC .. F01D 11/22; F01D 17/143; F05D 2250/41; F05D 2250/292; F05D 2260/57
See application file for complete search history.

(56) References Cited

U.S. PATENT DOCUMENTS 4,330,234 A * 5/1982 Colley ..... 415/173.2
5,203,673 A 4/1993 Evans
6,273,671 B1 * 8/2001 Ress, Jr. ..... 415/1
6,676,372 B2 1/2004 Scholz et al.
6,834,860 B2 12/2004 Rinaldo
7,686,569 B2 3/2010 Paprotna et al.
2002/0071763 A1 6/2002 Brandl et al.
2008/0063513 A1 * 3/2008 Afanasiev ..... 415/138
2011/0229301 A1 9/2011 Miller

FOREIGN PATENT DOCUMENTS

DE 1291560 B 3/1969
EP 1746256 A1 1/2007
JP 61250304 A 11/1986

OTHER PUBLICATIONS

European Search Report and Opinion issued in connection with corresponding EP Application No. 13166983 on May 19, 2015.

* cited by examiner

*Primary Examiner* — Craig Kim
*Assistant Examiner* — Michael Sehn
(74) *Attorney, Agent, or Firm* — Nixon & Vanderhye P.C.

(57) ABSTRACT

A clearance control system for a turbine having a stator assembly and a rotor assembly includes a hydraulic or pneumatic controller that axially drives, through a shaft, one or more actuators connected to the stator assembly casing. The controller causes relative movement between the stator and rotor assemblies to adjust the clearances between portions of the stator and rotor in accordance with the varying operating conditions of the turbine. More particularly, the controller moves the stator relative to the rotor in first and second axial directions to compensate for thermal expansion and contraction during the operating conditions of the turbine.

21 Claims, 7 Drawing Sheets

INNER TURBINE SHELL AXIAL MOVEMENT

TECHNICAL FIELD

The invention is directed to steam or gas turbines and especially to gas turbines having hydraulic or pneumatic actuator systems for movement of the inner turbine shell axially to achieve better clearance between the stator and rotor during operating conditions.

BACKGROUND OF THE INVENTION

Steam and gas turbines are used, among other purposes, to power electric generators. Gas turbines are also used, among other purposes, to propel aircraft and ships. A steam turbine has a steam path which typically includes in serial-flow relation, a steam inlet, a turbine, and a steam outlet. A gas turbine has a gas path which typically includes, in serial-flow relation, an air intake or inlet, a compressor, a combustor, a turbine, and a gas outlet or exhaust diffuser. Compressor and turbine sections include at least one circumferential row of rotating buckets. The free ends or tips of the rotating buckets are surrounded by a stator casing. The base or shank portion of the rotating buckets are flanked on upstream and downstream ends by the inner shrouds of stationary blades disposed respectively upstream and downstream of the moving blades.

The efficiency of the turbine depends in part on the axial clearance or gap between the rotor bucket shank portion angel wing tip(s) (seal plate fins), and a sealing structure of the adjacent stationary assembly, as well as the radial size of the gap between the tip of the rotating buckets and the opposite stationary assembly. If the clearances are too large, excessive valuable cooling air will leak through the gaps between the bucket shank and the inner shroud of the stationary blade and between the tips of the rotating buckets and the stationary assembly, decreasing the turbine's efficiency. If the clearances are too small, the rotating blades will strike the sealing structure of the adjacent or opposite stator portions during certain turbine operating conditions.

In this regard, it is known that there are clearance changes during periods of acceleration or deceleration due to changing centrifugal forces on the buckets, turbine rotor vibration, and/or relative thermal growth between the rotating rotor and the stationary assembly. During periods of differential centrifugal force, rotor vibration, and thermal growth, the clearance changes can result in severe rubbing of, e.g., the moving bucket tips against the stationary seal structures or against the stationary assembly. Increasing the tip to seal clearance gap reduces the damage due to metal-to-metal rubbing, but the increase in clearance results in efficiency loss.

More particularly, during turbine operating conditions the components of the turbine can thermally expand (or contract) at varying rates due to high operating temperatures in excess of 2,000 degrees Fahrenheit. The stator and rotor must be maintained apart from each other across all operating conditions to prevent damage from contact with each other. However, if a single fixed positional relationship between the stator and rotor is maintained across all operating conditions then for at least some operating conditions, i.e., startup, there will be compressed fluid leakage between the stator and rotor assemblies leading to operating inefficiencies.

It is known in the art to facilitate compressor casing movement by using pressure difference in plenums purged with extracted air. It is also known in the art to use a thermally expandable linkage to facilitate compressor casing movement and to use an air driven or stream driven piston to facilitate compressor casing movement.

SUMMARY

It is now proposed that a hydraulic or pneumatic system be used for axially moving the turbine inner casing to enable lower operating clearances. The proposed system results in better clearance between the stator and rotor. The proposed system also enables use of performance enhancers such as dual overlap on angel wing configuration, and tapered rotors.

In one exemplary implementation, the proposed system advantageously uses a hydraulic or pneumatic controller to directly drive a shaft connected to two actuators disposed at horizontal joints on the inner turbine casing. More particularly, in this first exemplary implementation, the two actuators are jointly driven by the controller and shaft in a first direction and jointly driven in a second direction opposite to the first direction.

In another exemplary implementation, the proposed system uses a hydraulic or pneumatic controller to drive a shaft to alternatively drive one of two actuators disposed at horizontal joints on the inner turbine casing. More particularly, in this second exemplary implementation, the controller drives one of the actuators in a first direction or alternatively drives the second one of the actuators in a second direction opposite to the first direction.

DETAILED DESCRIPTION

Figure 1:
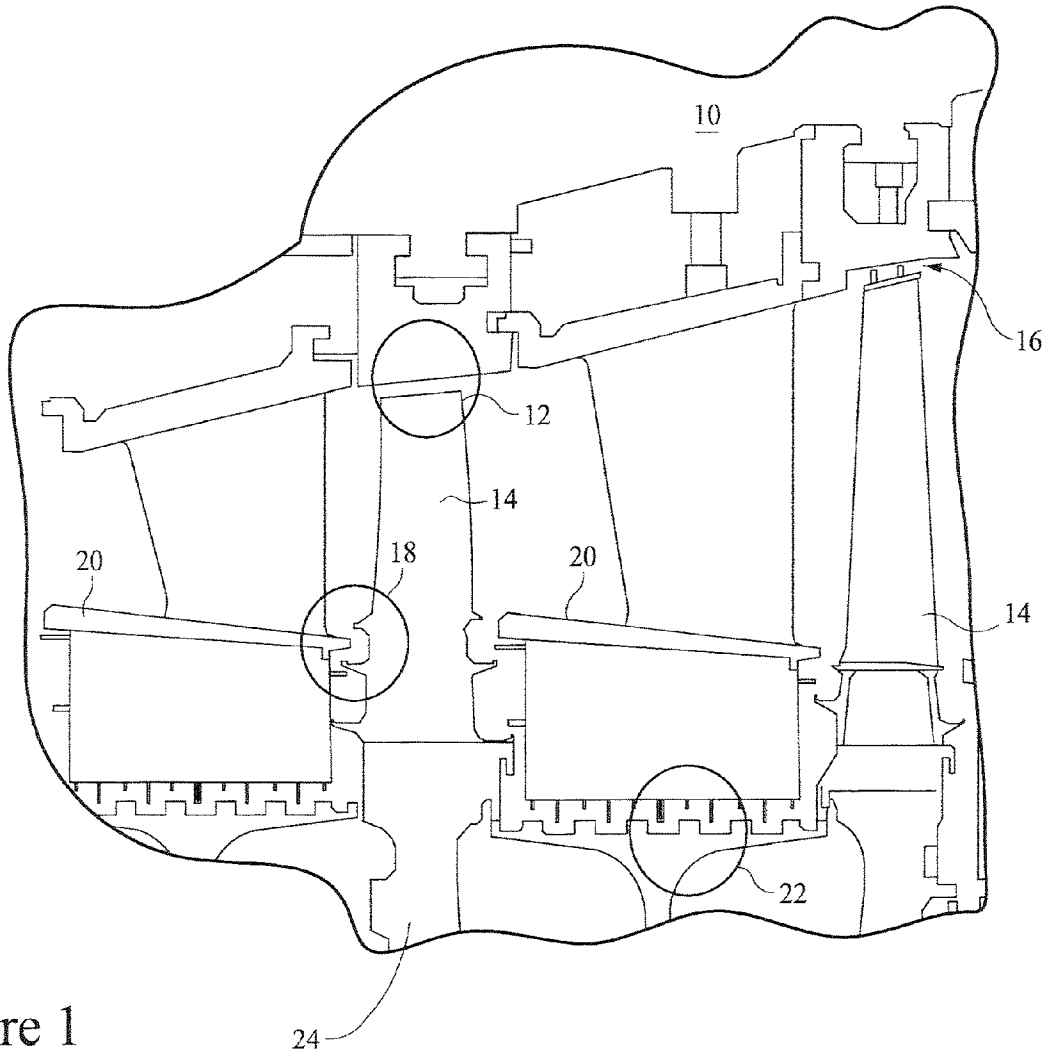
FIG. 1 is a cross sectional view of a turbine which identifies areas within the turbine where clearance control can be obtained by exemplary implementations of the disclosed subject matter.

FIG. 1 is a cross section of turbine 10 that shows where improved clearance control can be obtained by the exemplary implementations of the proposed system described herein. At location 12 a tapered design for the tips of rotating buckets 14, also shown at 16, can facilitate improved clearance control. At location 18, angel wing clearance control between the shank of rotating bucket 14, which forms part of rotor assembly 24, and stationary stator assembly 20 can be varied through use of the exemplary implementations of the proposed system. Likewise at location 22, reducing the axial gap between teeth on the rotor assembly 24 and stationary stator assembly 20 through use of the exemplary implementations of the proposed system provides variable clearance control. More particularly, clearance control at locations 12, 18 and 22 can be varied in accordance with thermal operating conditions by relative axial movement of the inner turbine casing and stationary stator assembly 20 in relation to the rotor assembly 24.

Figure 2:
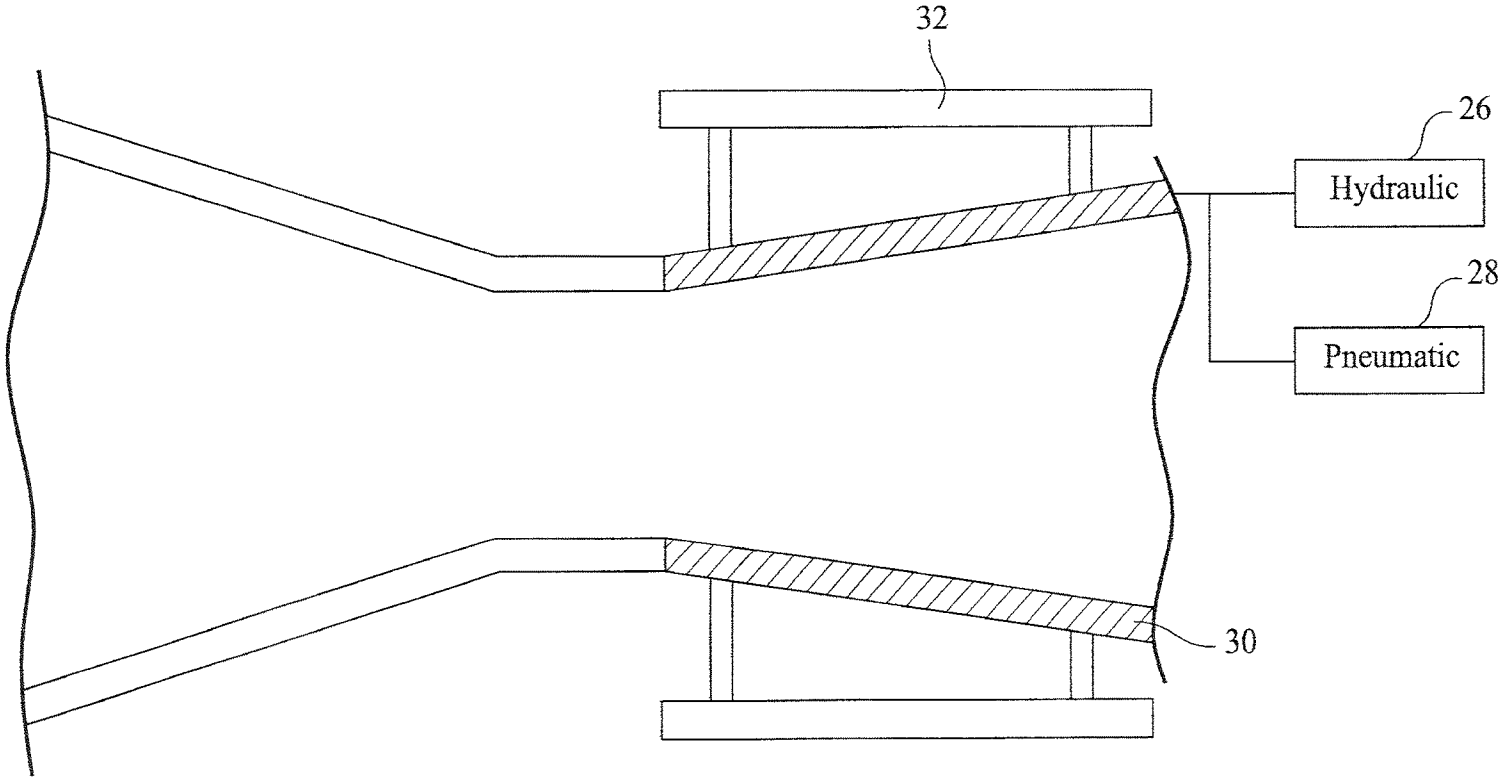
FIG. 2 is a schematic representation of an adjustable clearance control system in accordance with exemplary implementations of the disclosed subject matter.

FIG. 2 shows in schematic form the system for variable clearance control in a turbine to include hydraulic controller 26 or pneumatic controller 28 for moving the turbine inner casing 30 relative to the turbine outer casing 32. Since stator assembly 20, shown in FIG. 1, is fixedly connected to turbine inner casing 30, it follows that the movement of turbine inner casing 30 results in the movement of stationary stator assembly 20. Accordingly, the movement of turbine inner casing 30 and stationary stator assembly 20 is also relative to rotor assembly 24.

Figure 3:
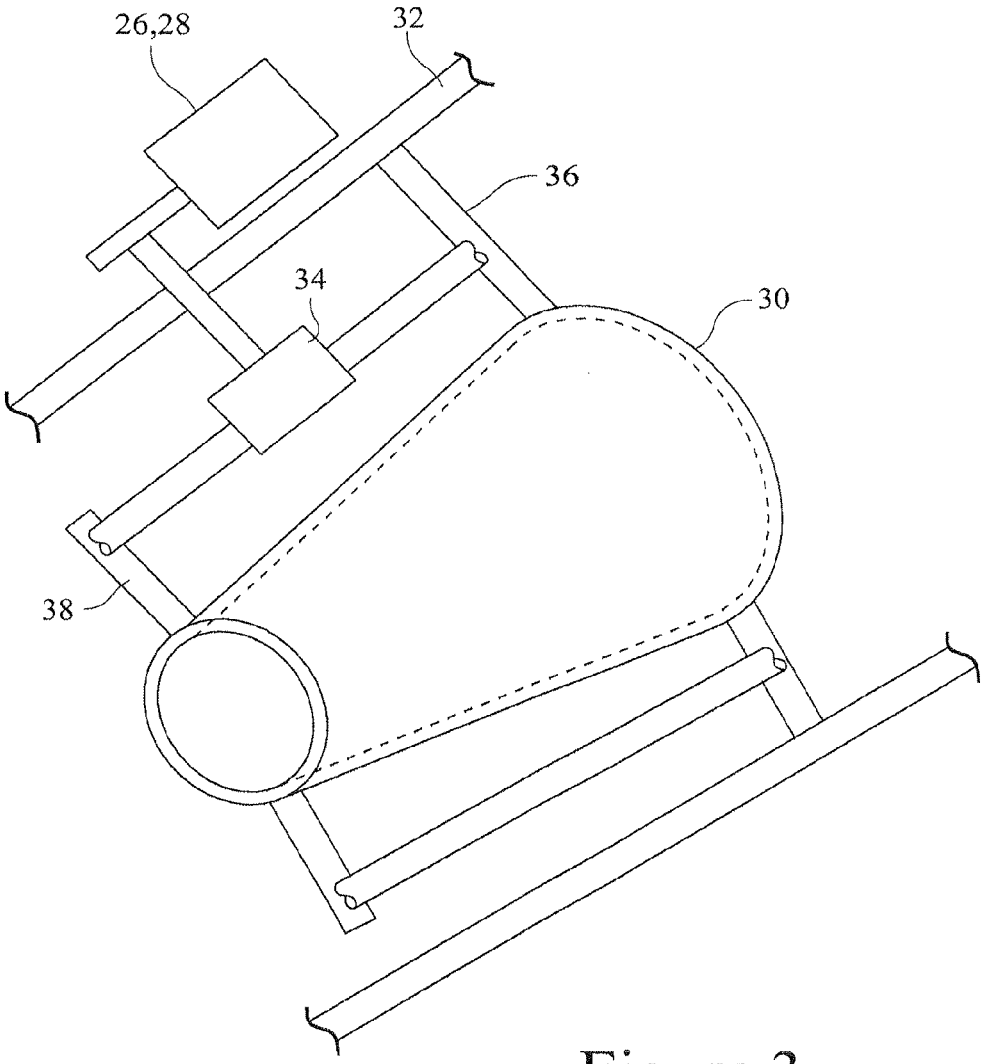
FIG. 3 is a schematic representation showing in greater detail components used in FIG. 2.

FIG. 3 shows schematically the arrangement of hydraulic controller 26 or pneumatic controller 28 to axially move turbine inner casing 30 relative to rotor assembly 24 (shown in FIG. 1) and turbine outer casing 32. Controller 26, 28 drives a shaft 34 connected to actuators 36, 38 to effect the relative movement.

Figure 4:
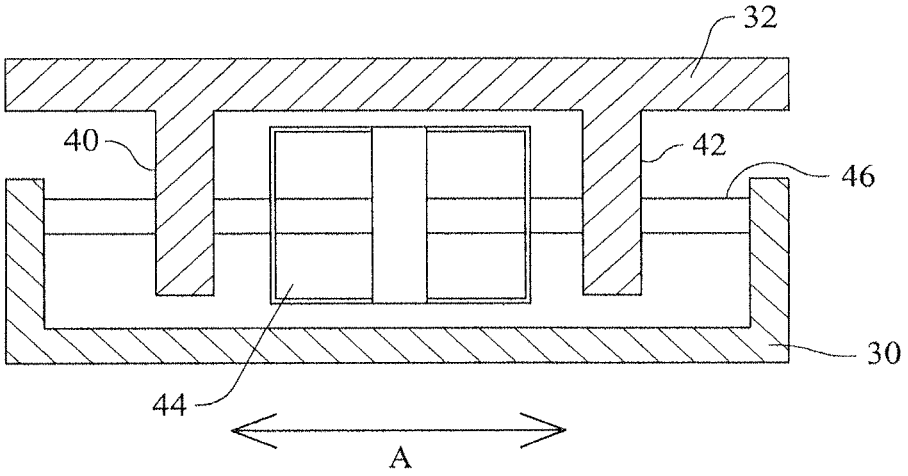
FIG. 4 is a schematic representation of an exemplary implementation of the proposed system using two actuators.

FIG. 4 shows another exemplary implementation of the proposed system to include actuators 40 and 42 fixedly connected to turbine outer casing 32 and driven by hydraulic controller 44 through actuator shaft 46 to move stationary stator assembly 20 and turbine inner casing 30 relative to turbine outer casing 32 and rotor assembly 24 (shown in FIG. 1) in first and second directions shown by directions arrow A. Although FIG. 4 has been shown with hydraulic controller 44, those ordinarily skilled in the art will readily recognize that the controller could be pneumatic.

Figure 5:
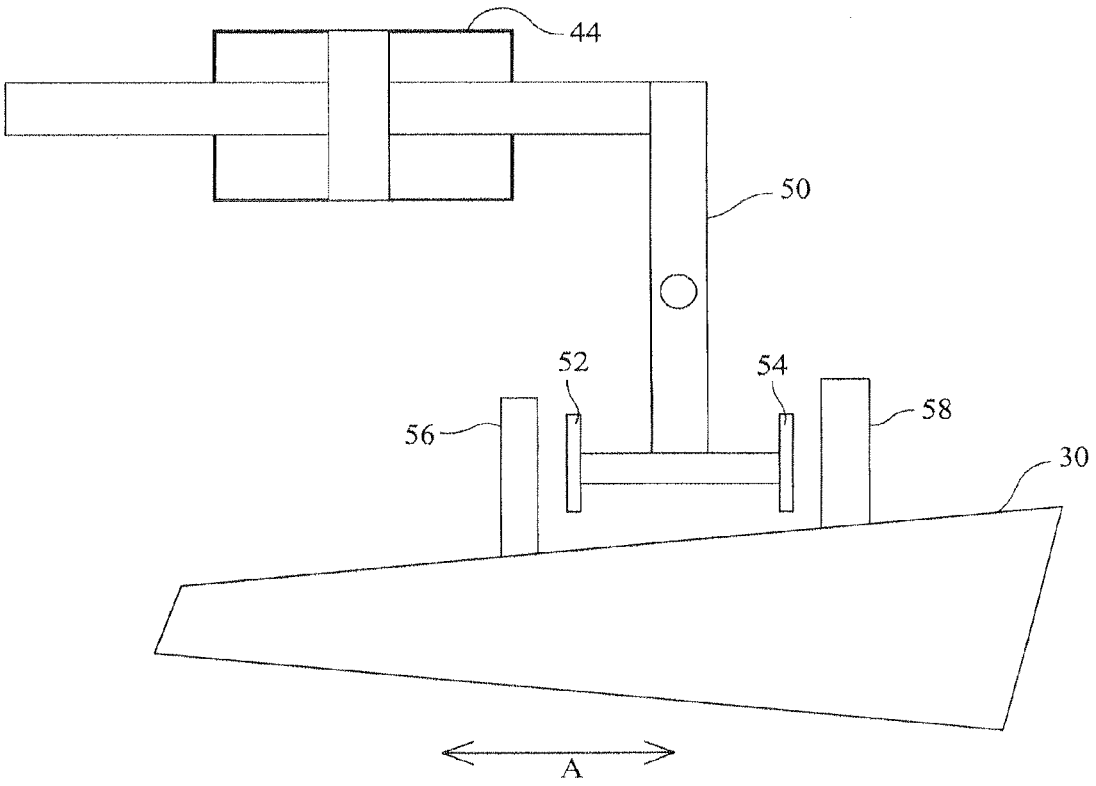
FIG. 5 is a schematic representation of an exemplary implementation of the proposed system using one actuator.

FIG. 5 shows yet another exemplary implementation of the proposed system to include actuators 56 and 58 which are alternatively driven by hydraulic controller 44 through actuator shaft 50 and abutting surfaces 52 and 54 to move turbine inner casing 30 and stationary stator assembly 20 (shown in FIG. 1) relative to the turbine outer casing and rotor assembly 24 in a first direction when abutting surface 52 of shaft 50 contacts actuator 56, and in a second, opposite, direction, when abutting surface 54 of shaft 50 contacts actuator 58, as shown by directions arrow A. Although FIG. 5 has been shown with hydraulic controller 44, those ordinarily skilled in the art will readily recognize that the controller could be pneumatic.

Figure 6A:
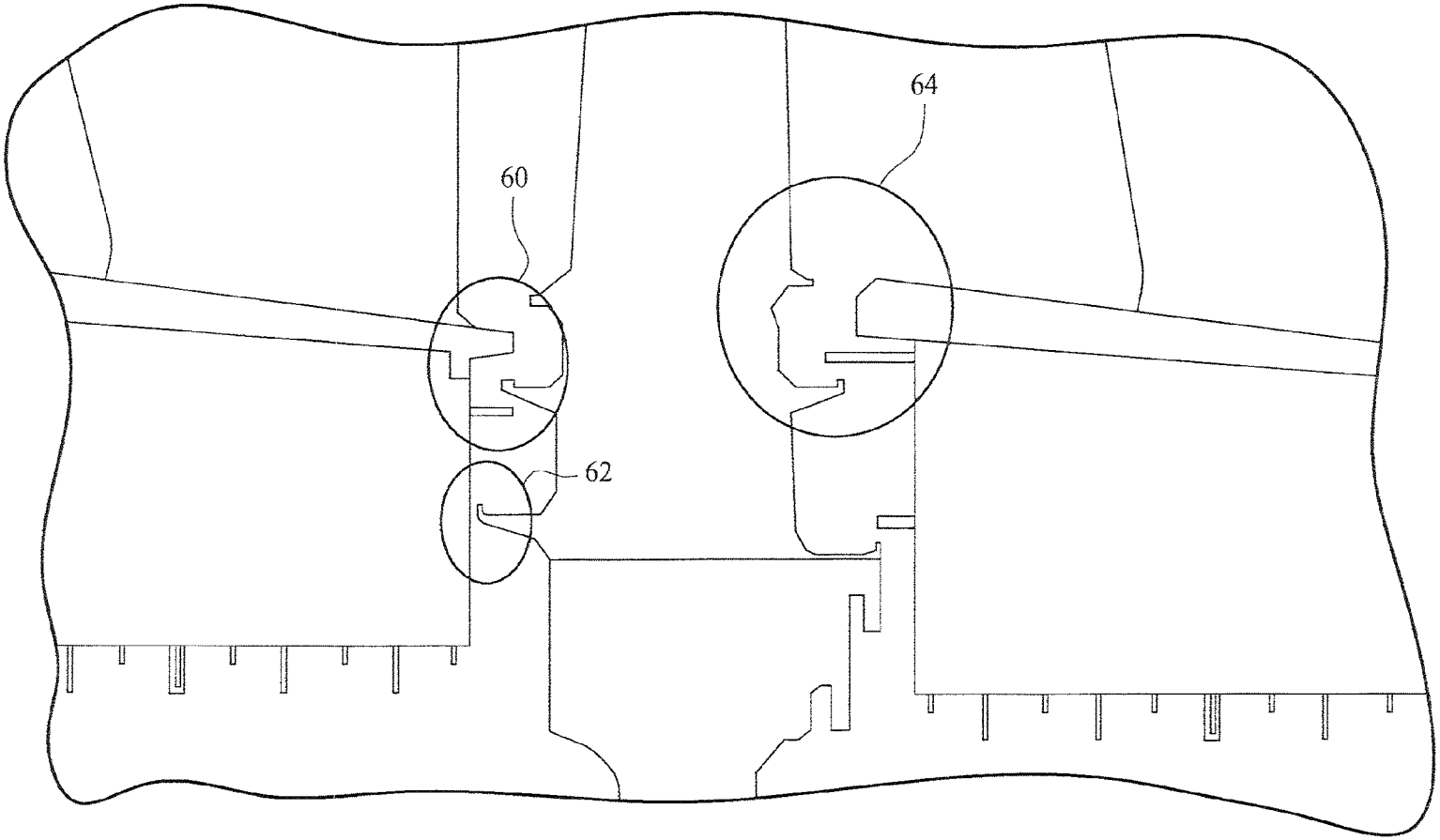
FIGS. 6A and 6B show adjustable clearances between dual overlaps on angel wings of rotating buckets and the stationary stator.
Figure 6B:
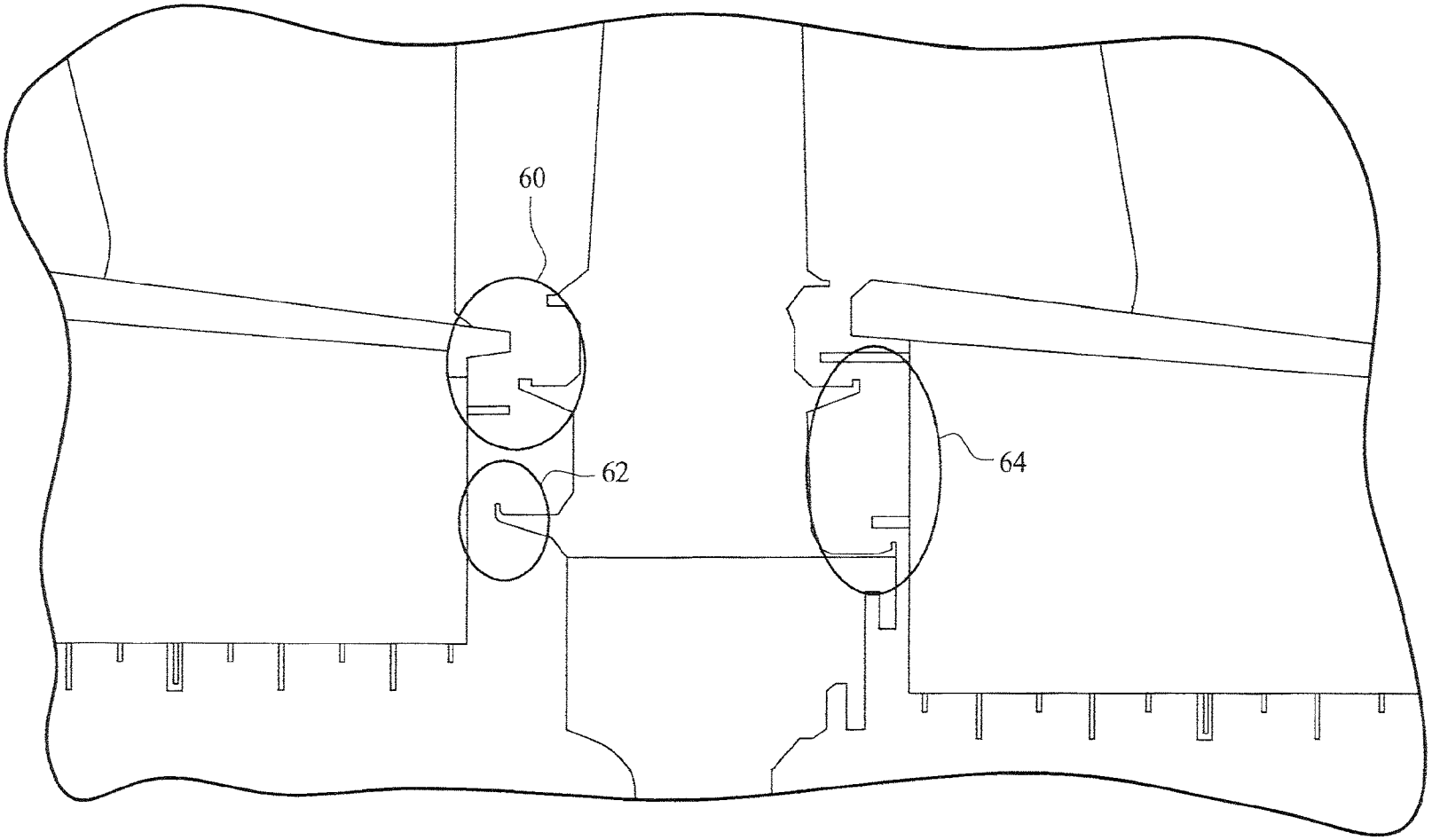

FIGS. 6A and 6B show still yet another exemplary embodiment wherein actuators such as those described in the previous exemplary embodiments can be used for adjusting and maintaining crucial clearances between the dual overlaps on angel wing configurations of rotating buckets and the stationary stator assembly. More particularly, FIG. 6A shows the casing in the aft/running position with a dual overlap at the angel wing location 60, maintaining a necessary axial gap clearance at location 62, while maintaining an overlap at location 64. FIG. 6B shows that the casing has been moved forward thus lessening the dual overlaps at location 60, increasing the axial gap at location 62, and increasing the dual overlaps at location 64.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A clearance control system for a turbine having a stator assembly and a rotor assembly, the system comprising:

a controller for axially moving the stator assembly relative to the rotor assembly and an outer casing of the turbine;

a pair of actuators fixedly connected to an inner casing of the turbine that is fixedly connected to the stator assembly; and an actuator shaft adapted to alternately engage a first actuator of the pair of actuators and a second actuator of the pair of actuators such that when the actuator shaft engages the first actuator, the actuator shaft moves the pair of actuators, the inner casing and the stator assembly in a first axial direction relative to the rotor assembly and when the actuator shaft engages the second actuator, the actuator shaft moves the pair of actuators, the inner casing and the stator assembly in a second axial direction relative to the rotor assembly, wherein said controller moves the stator assembly relative to the rotor assembly and the outer casing of the turbine in an axial direction to adjust the clearance between certain portions of the rotor assembly and the stator assembly.

2. The clearance control system of claim 1 wherein the controller is hydraulically controlled.

3. The clearance control system of claim 1 wherein the controller is pneumatically controlled.

4. The clearance control system of claim 1 wherein adjusting the clearance between certain portions of the rotor assembly and the stator assembly comprises providing a tapered surface on tips of rotating buckets that comprise the rotor assembly.

5. The clearance control system of claim 1 wherein the rotor assembly comprises rotating buckets and wherein adjusting the clearance between certain portions of the rotor assembly and the stator assembly comprises adjusting angel wing clearance between shanks of the rotating buckets and stator assembly.

6. The clearance control system of claim 1 wherein adjusting the clearance between certain portions of the rotor assembly and the stator assembly comprises reducing an axial gap between teeth on the rotor assembly and stator assembly.

7. A clearance control system for a turbine having a stator assembly and a rotor assembly, the system comprising:

a controller for axially moving the stator assembly relative to the rotor assembly and an outer casing of the turbine;

a pair of actuators fixedly connected to an inner casing of the turbine that is fixedly connected to the stator assembly; and an actuator shaft adapted to selectively engage with a first actuator of said pair of actuators to axially move the stator assembly in a first direction relative to the rotor assembly and selectively engage with a second actuator of said pair of actuators to axially move the stator assembly in a second direction, the actuator shaft being axially movable between the first and second actuators to engage one of the first and second actuators without engaging the other of the first and second actuator, wherein said controller moves the stator assembly relative to the rotor assembly and the outer casing of the turbine in an axial direction in said first and second directions to adjust the clearance between certain portions of the rotor assembly and the stator assembly.

8. The clearance control system of claim 7 wherein the controller is hydraulically controlled.

9. The clearance control system of claim 7 wherein the controller is pneumatically controlled.

10. The clearance control system of claim 7 wherein adjusting the clearance between certain portions of the rotor assembly and the stator assembly comprises providing a tapered surface on tips of rotating buckets that comprise the rotor assembly.

11. The clearance control system of claim 7 wherein the rotor assembly comprises rotating buckets and wherein adjusting the clearance between certain portions of the rotor assembly and the stator assembly comprises adjusting angel wing clearance between shanks of the rotating buckets and stator assembly.

12. The clearance control system of claim 7 wherein adjusting the clearance between certain portions of the rotor assembly and the stator assembly comprises reducing an axial gap between teeth on the rotor assembly and stator assembly.

13. A turbine comprising:

a rotor assembly;

a stator assembly; and a clearance control system, wherein the clearance control system comprises:

a controller for axially moving the stator assembly relative to the rotor assembly and an outer casing of the turbine;

a first actuator fixedly connected to an inner casing of the turbine that is fixedly connected to the stator assembly;

a second actuator opposing the first actuator and fixedly connected to the inner casing of the turbine; and an actuator shaft positioned between the first and second actuators, the actuator shaft being adapted to alternately engage the first actuator and the second actuator of said pair of actuators to axially move the stator assembly relative to the rotor assembly, wherein the first and second actuators are spaced far enough apart so that there is a delay between movement of the actuator shaft toward one of the first and second actuators and engagement with said one of the first and second actuators, and wherein said controller moves the stator assembly relative to the rotor assembly and the outer casing of the turbine in an axial direction to adjust the clearance between certain portions of the rotor assembly and the stator assembly.

14. The turbine of claim 13 wherein the controller is hydraulically controlled.

15. The turbine of claim 13 wherein the controller is pneumatically controlled.

16. The turbine of claim 13 wherein adjusting the clearance between certain portions of the rotor assembly and the stator assembly comprises providing a tapered surface on tips of rotating buckets that comprise the rotor assembly.

17. The turbine of claim 13 wherein the rotor assembly comprises rotating buckets and wherein adjusting the clearance between certain portions of the rotor assembly and the stator assembly comprises adjusting angel wing clearance between shanks of the rotating buckets and stator assembly.

18. The turbine of claim 13 wherein the actuator shaft comprising opposing abutting surface configured to abut a respective actuator when the actuator shaft engages the respective actuator.

19. The turbine of claim 18 wherein adjusting the clearance between certain portions of the rotor assembly and the stator assembly comprises reducing an axial gap between teeth on the rotor assembly and stator assembly.

20. The turbine of claim 18 wherein the first and second actuators are axially aligned with each other.

21. The turbine of claim 13, wherein the adjustment of the clearance between certain portions of the rotor assembly and the stator assembly includes an adjustment of an axial gap between teeth on the rotor assembly and the stator assembly.

* * * * *